US012117017B2

(12) United States Patent
Sullivan et al.

(10) Patent No.: US 12,117,017 B2
(45) **Date of Patent: *Oct. 15, 2024**

(54) CENTRIFUGAL PUMPS, CASINGS AND VEHICLES USING THE SAME

(71) Applicant: W.S. Darley & Co., Itasca, IL (US)

(72) Inventors: Shane Sullivan, Chippewa Falls, WI (US); Wayne Hable, Chippewa Falls, WI (US)

(73) Assignee: W.S. Darley & Co., Itasca, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/514,219

(22) Filed: Nov. 20, 2023

(65) Prior Publication Data

US 2024/0084817 A1 Mar. 14, 2024

Related U.S. Application Data

(63) Continuation of application No. 17/731,959, filed on Apr. 28, 2022, now Pat. No. 11,873,837.

(60) Provisional application No. 63/228,434, filed on Aug. 2, 2021.

(51) Int. Cl.
*F04D 29/44* (2006.01)
*F04D 29/42* (2006.01)

(52) U.S. Cl.
CPC ..... *F04D 29/428* (2013.01); *F04D 29/4293* (2013.01); *F04D 29/445* (2013.01)

(58) Field of Classification Search
CPC ..... F04D 13/14; F04D 29/426; F04D 29/428; F04D 29/4293; F04D 29/126; F04D 1/006
See application file for complete search history.

(56) References Cited

U.S. PATENT DOCUMENTS 3,289,598 A * 12/1966 Buse ..... F04D 29/445 415/211.1
4,406,583 A * 9/1983 Becker ..... F04D 29/426 415/206
6,146,095 A * 11/2000 Bross ..... F04D 29/448 415/207
7,517,186 B2 * 4/2009 Seitz ..... F04D 29/426 415/206

* cited by examiner

*Primary Examiner* — Justin D Seabe
(74) *Attorney, Agent, or Firm* — Anthony J. Bourget

(57) ABSTRACT

Single suction centrifugal pumps, pump casings, pump systems and vehicles for using pumps which include a single piece casing having a first cut-water fluid flow path, a first discharge nozzle, and a second discharge nozzle, the first cut-water fluid flow path communicating with the first discharge nozzle and the second discharge nozzle and the nozzles being situated at opposing ends of the pump such that center outputs of the nozzles are offset from a horizontal centerline of the casing and the first nozzle is positioned a greater distance from a lower casing wall of the pump as compared to the second nozzle so that the casing may be connected to output piping for both sides of the vehicle and at a low profile within the vehicle.

14 Claims, 9 Drawing Sheets

CENTRIFUGAL PUMPS, CASINGS AND VEHICLES USING THE SAME

CROSS-REFERENCE TO RELATED APPLICATIONS

This application claims the benefit of and priority to U.S. patent application Ser. No. 17/731,959 filed Apr. 8, 2022 for CENTRIFUGAL PUMPS, CASINGS AND VEHICLES USING THE SAME, which claims the benefit of and priority to U.S. Provisional Patent Application Ser. No. 63/228,434 filed Aug. 2, 2021 for CENTRIFUGAL PUMPS, CASINGS AND SYSTEMS, incorporated herein by reference in its entirety for continuity of disclosure.

BACKGROUND OF THE INVENTION

Centrifugal pumps have been commonplace for ages and have been used in numerous applications. A relatively recent development has been a powerful firefighting type of pump having a low profile while still allowing discharge at opposite ends of the pump, such as that found in Seitz et al. U.S. Pat. No. 7,517,186. While this and other examples have benefits, there is room for improvement.

SUMMARY OF THE INVENTION

In one aspect the invention pertains to a single piece pump casing which allows the pump to be placed in a relatively low position upon a chassis of a firefighting vehicle to allow improved storage, function and spacing under a cab portion of the vehicle and functionality of the vehicle while also allowing discharge flow from the pump at opposite sides of the vehicle. The pump casing has a first cut-water fluid flow path, a second cut-water fluid flow path, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the first discharge nozzle and the second discharge nozzle situated substantially at opposing ends of the casing, the first discharge nozzle defining a first center output point and the second discharge nozzle defining a second center output point, the first center output point and the second center output point defining a line offset from a horizontal center point of the casing. In aspects, the design allows for the pump to be positioned at a relatively low profile upon a chassis of a vehicle, allowing for space savings and flexible positioning, and allowing outputs to either or both sides of a vehicle. In further aspects a centrifugal pump includes an impeller contained within the casing.

In a further aspect the invention includes a single-piece casing for a single suction centrifugal pump where a first discharge outlet extends a greater distance from the lower casing wall compared to a second discharge outlet so that the casing may connect with piping and where the discharge outlets are offset above a horizontal centerline of the casing so the casing may be positioned low within a vehicle while avoiding contact with a main drive shaft of the vehicle. In aspects, the first discharge outlet is at a discharge arm which extends a greater distance from the lower casing compared to a discharge arm for the second discharge outlet and includes a third discharge opening to discharge fluid in a downward direction from the casing which allows for flexibility and space savings in configuration of discharge from the pump. In further aspects a centrifugal pump includes an impeller contained within the casing.

A further aspect includes a vehicle having a pump with features of discharge outlets offset from a horizontal centerline of a single piece casing of the pump while also having an extended discharge outlet so that the single suction centrifugal pump may be offset horizontally and in close spaced relationship with a main drive shaft of the vehicle. The pump may be offset horizontally and vertically to accommodate a lower profile, and which has an added benefit of also accommodating a downward discharge from the pump.

These and other aspects are more fully presented herein.

The above partial summary of the present invention is not intended to describe each illustrated embodiment, aspect, or every implementation of the present invention. The figures and detailed description that follow more particularly exemplify these embodiments and further aspects of the invention.

Figure 5:
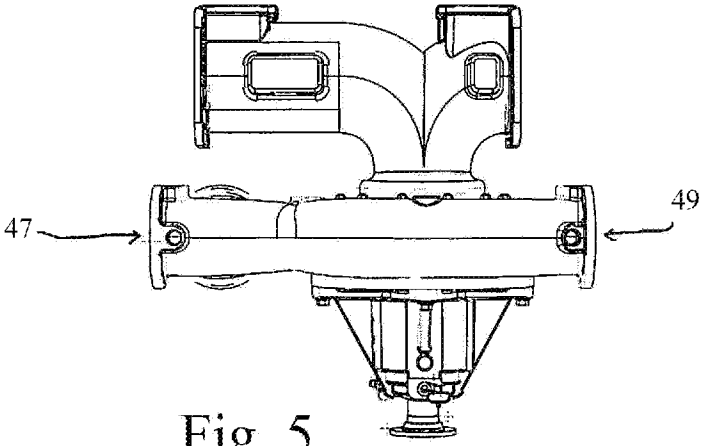
FIG. 5 is a top view of FIG. 1.

While the invention is amenable to various modifications and alternative forms, specifics thereof have been shown by way of example in the drawings and will be described in detail. It should be understood, however, that the intention is not necessarily to limit the invention to the particular embodiments or aspects described. On the contrary, the intention is to cover all modifications, equivalents, and alternatives falling within the spirit and scope of the invention and as defined by the appended claims.

DETAILED DESCRIPTION OF THE INVENTION

Figure 2:
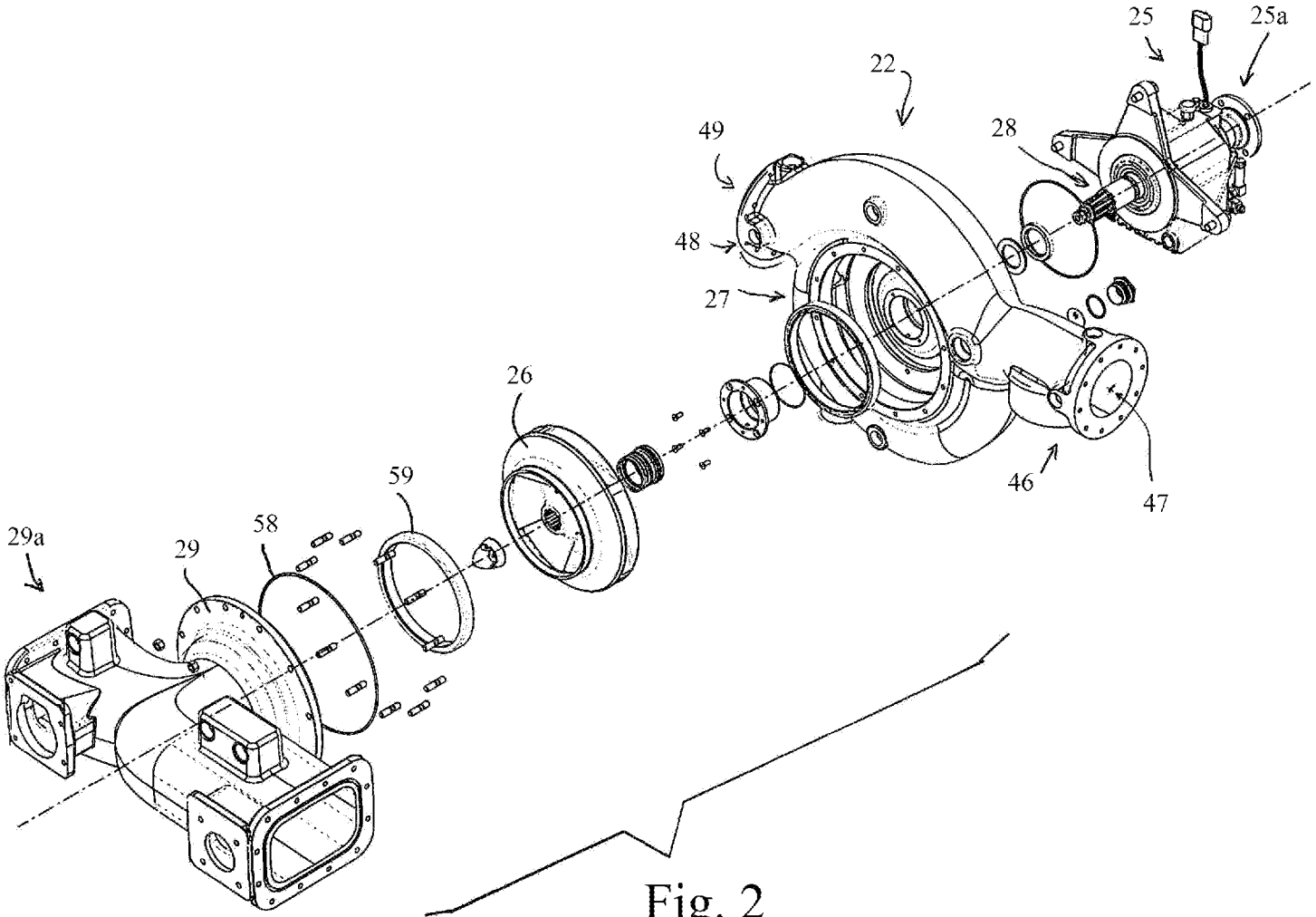
FIG. 2 is an exploded perspective view of FIG. 1.

Referring to FIGS. 1-12, casings, pumps, systems and vehicles are presented in various aspects of the invention. A pump according to the present invention is generally depicted with reference to numeral 20. In one aspect, pump 20 includes a casing 22 which in one aspect is a single piece metal casting. The casing 22 may be made of metals including iron or aluminum or other metals or alloys. Casing 22 includes an outer casing wall 24. Casing wall 24 in one aspect is curved or generally circular, and defines an impeller cavity 27 in which is positioned an impeller 26. Impeller drive shaft 28 runs through center opening 23 and cavity 27 and secures impeller 26 to drive the impeller 26. A drive box 25 houses the drive shaft 28 and is capable of housing bearings and seals and/or gears and lubricant and is driven by yoke 25*a* connected to a drive source to power pump 20. A suction head 29 overlays impeller 26. Fluid is introduced through head 29 (and other suction plumbing 29*a*) and into impeller 26 for subsequent discharge through discharge nozzles 46, 48. The fluid is used for firefighting purposes, for instance. Pump 20 further includes O rings 58, seal rings 59 and other common pump hardware as generally shown in FIG. 2.

Figure 3:
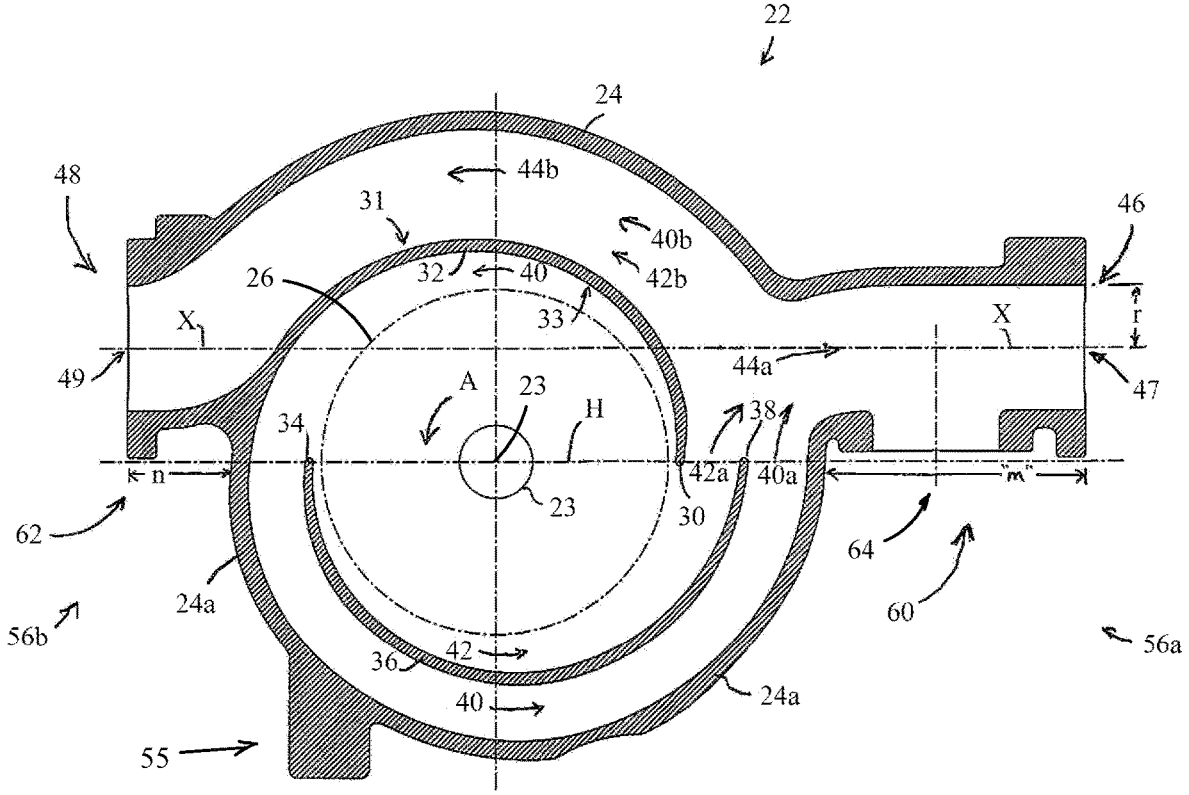
FIG. 3 is a section view taken along line 3-3 of FIG. 1 with portions removed for clarity.

With particular reference to FIG. 3, casing 20 includes a first cut-water wall 32 having a first cut-water 30 disposed at an end thereof. First cut-water wall 30 includes an impeller side 33 having a generally concave configuration, and a casing side 31 having a generally convex configuration. First cut-water wall 32 in part defines first cut-water fluid flow path 40. As fluid exits spinning impeller 26 the fluid travels along first cut-water fluid flow path 40. Subsequent flow of the fluid within path 40 is described further below.

Casing 22 includes second cut-water wall 36 having a second cut-water 34 disposed at one end thereof and a trailing end 38 disposed at another end thereof. Second cut-water wall 36 in part defines second cut-water fluid flow path 42. As fluid exits spinning impeller 26 the fluid travels along second cut-water fluid flow path 42. Subsequent flow of the fluid within path 42 is described further below.

First cut-water fluid flow path 40 and second cut-water fluid flow path 42 communicate to join into a first joint water path 44*a* and a second joint water path 44*b*. Casing 22 further includes a first discharge nozzle 46 and a second discharge nozzle 48. Both first path 40 and second path 42 communicate with first discharge nozzle 46 and second discharge nozzle 48. Both first joint water path 44*a* and second joint water path 44*b* communicate with first discharge nozzle 46 and second discharge nozzle 48. First discharge nozzle 46 and second discharge nozzle 48 are situated at or substantially at opposing ends 56*a*, 56*b* of casing 22. In further aspects discharge nozzles 46, 48 have a center output 47, 49 (particularly, first center output point 47 and second center output point 49) which define a center point of the respective nozzles. A horizontal centerline H aligns with a horizontal center of impeller drive shaft 28. The center output points 47, 49 define a line "X" which line X is offset from horizontal centerline H. Alignment of nozzles 46, 48 accommodates for efficient dual outlets to be extended to both sides of an emergency vehicle. An emergency response vehicle may be a fire truck such as, but not limited to, the vehicle 10 shown in FIG. 12. Vehicle 10 may include a fire truck which may include a tilt-forward cab 12 as well as various rear panels and compartments, a holding tank or tanks, discharge panels and various other components which are common to firetrucks or other emergency response vehicles. The invention is not limited to the vehicle 10 as shown, and may be include, and be used with, other emergency response vehicles and fire trucks or fire apparatus. Alignment of nozzles 46, 48 about the offset line X accommodates a lower profile pump 20 for space savings as referenced herein.

In one aspect nozzles 46, 48 have a terminal flow path radius "r" (i.e., a flow path radius at a terminal end of nozzle 46). In one aspect the radius "r" is 2 inches. In other aspects the radius "r" may be less than or greater than 2 inches. In further aspects, nozzles 46, 48 have a terminal flow path which is not necessarily circular in cross-section, and may have a rectangular, oval or other cross-section configuration. In aspects, line X (and corresponding output points 47, 48 of nozzles 46, 48) is offset from centerline H by a measure of at least "r" length. Having such offset of "r" dimension provides a feature for positioning casing 22 lower upon a vehicle, which results in increased spaced savings or space utilization of vehicle areas above and/or adjacent casing 22. Providing a greater offset of line X from horizontal centerline H allows for a lower placement of casing 22 compared to applications which do not have such configuration. In one aspect, casing 22 defines a center opening 23 which passes through the casing 22. The center opening 23 has a radius r' with a center point 23' of the center opening 23 defining a horizontal center point which lies along centerline H. In one aspect, line X is offset from centerline H by a measure of at least r' length. In a further aspect, line X is offset from centerline H by about 3 to 4 inches. In aspects line X is offset from centerline H by about 3.5 inches to assure a substantial benefit in space savings while still maintaining clearance from other components of the vehicle. Such offset allows casing 22 and pump 20 to be set lower within a vehicle. In one aspect, line X is offset from centerline H by over 3.6 inches, resulting in a corresponding lowering of casing 22 as compared to prior applications. Such lowering is a substantial lowering and increase in space utilization for a vehicle into which pump 20 is positioned. In aspect such substantial lowering accommodates more space within a cab portion of the vehicle which is positioned above the pump. Use of the offset and lowering of the profile position of the pump minimizes or eliminates the need to have a projection into the cab area to accommodate for pump clearance. This lessens or eliminates a "bump" which might otherwise be positioned at the floor of the cab.

In a further aspect casing 22 includes a foot 55 used to set upon or connect to a flange which in one instance is connected to rail 100. Connection of nozzles 46 48 to discharge piping and connection of foot 55 to rail 100 provides a secure three-point contact to secure the pump casing 20. In one aspect foot 55 is configured with a planar lower surface such that when the planar lower surface is oriented horizontally, line X is also oriented horizontally or substantially horizontally. Plastic or rubber washers or bushings may be positioned at the respective connections of the casing 20.

In operation, fluid from path 40 continues to circulate through casing 22. Particularly, a portion of fluid travels along first cut-water fluid flow path 40*a* to exit at discharge nozzle 46, and a portion travels, or may travel, along first cut-water fluid flow path 40*b* to exit at discharge nozzle 48. Likewise, fluid from path 42 continues to circulate through casing 22. Particularly, a portion of fluid travels along second cut-water fluid flow path 42*a* to exit at discharge nozzle 46, and a portion travels, or may travel, along second cut-water fluid flow path 40*b* to exit at discharge nozzle 48. Joint water path 44*a* includes both first path 40*a* and second path 42*a*, and joint water path 44*b* includes both first path 40*b* and second path 42*b*. It may be appreciated that at least a portion of path 40 and at least a portion of path 42 define path 40*b* to create joint water path 44*b*. As such, both the impeller side 33 and casing side 31 of wall 32 in part define first cut-water fluid flow path 40. First cut-water wall 32 defines in part flow path 40 and defines in part second joint-water path 44*b*. Having joint-water path 44*b* allows pump 20 to efficiently deliver fluid to ends 56*a*, 56*b* in a low-profile arrangement. While other pump designs may deliver fluid to both ends of a vehicle, joint-water path 44*b* contained entirely within casing 22 achieves an efficient low-profile arrangement. Having outputs 47, 49 of discharge nozzles 46, 48 arranged along a line X which is offset upward from a center point 23' of the center opening 23 allows for a lower profile configuration. As a single casting, casing 22 also accommodates for efficient manufacture and assembly of pump 20 and positioning and connecting within a vehicle. In one aspect pump 20 includes a single impeller 26 (one and only one impeller in such aspect) and thus a single suction for efficient use and plumbing. In aspects, either of nozzles 46, 48 may be closed to allow or force liquid to flow to the other open nozzle to allow a user to select which side (or both sides) of the pump (or fire truck) for discharge of liquid.

Joint-water path 44*b* allows for efficient operation of pump 20 especially where an operator desires to vary the fluid output through respective discharge nozzles 46, 48. For instance, a user may close off (or partially close) fluid flow through nozzle 46 without disrupting radial balance of impeller 26, since the entire output from flow path 40 and flow path 42 would then be directed through nozzle 48. Likewise, if a user were to close fluid flow through nozzle 48 (or partially close the flow), the output from flow path 40 and flow path 42 would then be directed through nozzle 46. If respective nozzles 46, 48 were to be otherwise fed directly from respective flow paths without the combining of fluid in a joint water path, radial forces could disrupt the balance of impeller 26 impacting performance and pump life. Having water paths 40 and 44*b* contained within a single casing further allows for a low profile which would otherwise require additional or external plumbing about the pump casing to supply opposite sides of the vehicle. Other outlets or nozzles may also be provided on the casing 22, including at discharge arm 60.

In further aspects of operation, impeller 26 spins in a first direction represented by arrow A. While arrow A depicts a counterclockwise direction (when viewed opposite a suction side of the casing 20), it may be appreciated that pump 20 may be designed for impeller 26 to spin in a clockwise direction. The first-direction spinning impeller 26 releases fluid (such as water or foam for fighting fires) into paths 40, 42. In aspects, pump 20 includes means for continuing transporting fluid in the first direction. Means for transporting is represented by reference numeral 44*b*, which may include means such as second joint-water path 44*b*, first cut-water fluid flow path 40*b*, and second cut-water fluid flow path 42*b*. In one aspect, means 44*b* has a generally arch-like configuration, or lies generally along a radius or modified radius. In one aspect means for transporting includes a joint-water path spanning substantially from a first end 56*a* to a second end 56*b* of the pump 20. In one aspect means 44*b* spans from adjacent trailing edge 38 to first discharge outlet 46 and continues to span to second discharge outlet 48. In one aspect means for continuing transporting is contained entirely within single piece casing 22. Providing a simple single, non-split, casing design in which all water paths are located (including means for continuing transportation, such as path 44*b* which curves to either side of the casing) allows for ease of manufacture, assembly, hook-up, and use. It may be appreciated that connections to the nozzles of the pump may likewise be confined to a modest space to achieve an overall low-profile solution.

For pump 20 to accommodate dual output at discharge nozzles 46, 48, pump 20 in one aspect includes joint-water path 44*b* which spans at least 45 degrees, and in some aspects at least 135 degrees, and even at least 180 degrees or greater than 180 degrees in further aspects. Having joint-water path 44*b* span at least 135 degrees accommodates for joint-water path 44*b* to wrap back or span to a significant degree, and accommodates a lower profile casing (and/or elimination of external conduit to supply fluid to opposite sides of the firetruck) and provides meaningful spacing of respective outputs or nozzles 46, 48. The joint-water path 44*b* spans in a curving manner along an arch generally defined by an arch line spanning from trailing edge 38 to discharge outlet 48. In one aspect arch line is a curving centerline of joint-water path 44*b*. As shown in FIG. 3, joint-water path 44*b* may commence adjacent trailing edge 38 and follow generally circumferentially in direction A to discharge nozzle 48. In one aspect trailing edge 38 aligns substantially along reference line H. In one aspect cut-water 30 also substantially aligns along reference line H. In other aspects cut-water 30 and 34 are positioned in a spaced relation with respect to line H. Reference line H is a horizontal centerline running through impeller shaft 28. In one aspect joint-water path 44*b* spans approximately 180 degrees from trailing edge 38 to reference line H. In one aspect joint-water path 44*b* spans greater than 180 degrees to accommodate configuration of discharge nozzles being positioned at substantially opposite ends 56*a*, 56*b*. In one aspect, due to the substantial offset of reference line X (defined by center points 47, 49), joint water path 44*b* avoids spanning across horizontal centerline H. In aspect joint water path 44*b* spans less than 180 degrees. In aspects, all liquid output from nozzles 46, 48 occurs above horizontal centerline H.

In further aspects with respect to FIG. 3 first cut-water fluid flow path 40 is defined in part by lower casing wall 24*a*. The first discharge nozzle 46 is positioned at a first discharge arm 60 which extends outward from the lower casing wall 24*a*. Likewise, second discharge nozzle 48 is positioned at a second discharge arm 62 which extends outward from the lower casing wall 24*a*. In one aspect, discharge arms 60, 62 are positioned above horizontal centerline H. In one aspect first discharge arm 60 extends from lower casing wall 24*a* a first distance "m" and second discharge arm 62 extends from lower casing wall 24*a* a second distance "n". In one aspect the first distance m is greater than the second distance n. In one aspect distance m is twice as great as distance n, and in other aspects distance m is greater than twice distance n. In a further aspect distance m is about 8 inches and distance n is about 3 inches. In further aspects distance m is greater than 8.2 inches and distance n is greater than about 3.3 inches. Other measures for distance m and distance n may be established or mixed and matched to provide efficiency of connection to discharge piping.

In one aspect first discharge arm 60 is positioned adjacent trailing edge 38 of second cut-water wall 36, while second discharge arm 62 is position distal the trailing edge 38. In further aspects, fluid travels upward at the exit (adjacent trailing edge 38) from the first cut-water fluid flow path 40.

Figure 4:
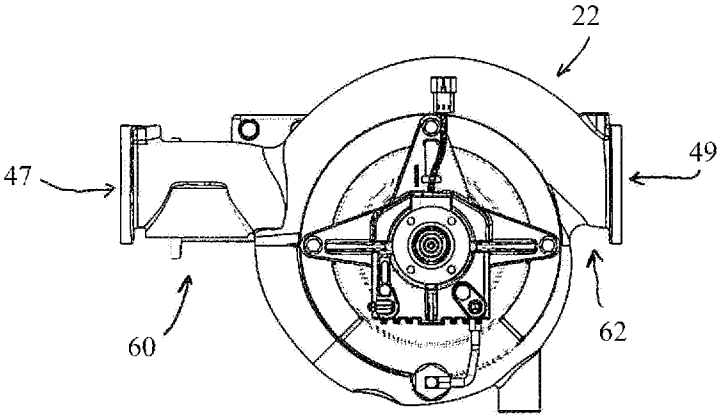
FIG. 4 is a rear view of FIG. 1.
Figure 1:
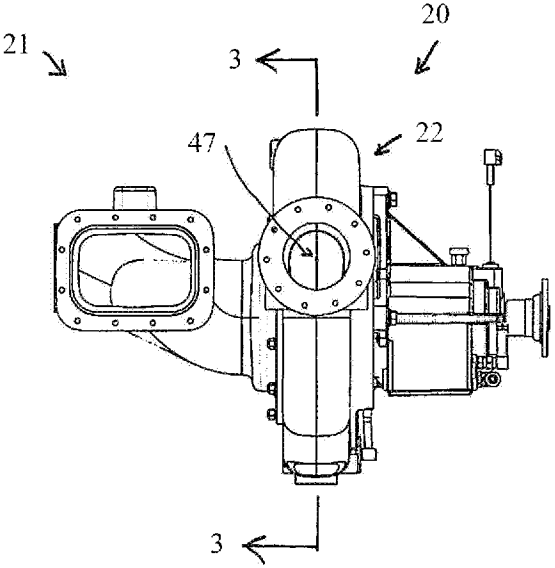
FIG. 1 is a side view of a pump system, pump, pump casing and related components in accordance with one aspect of the invention.
Figure 6:
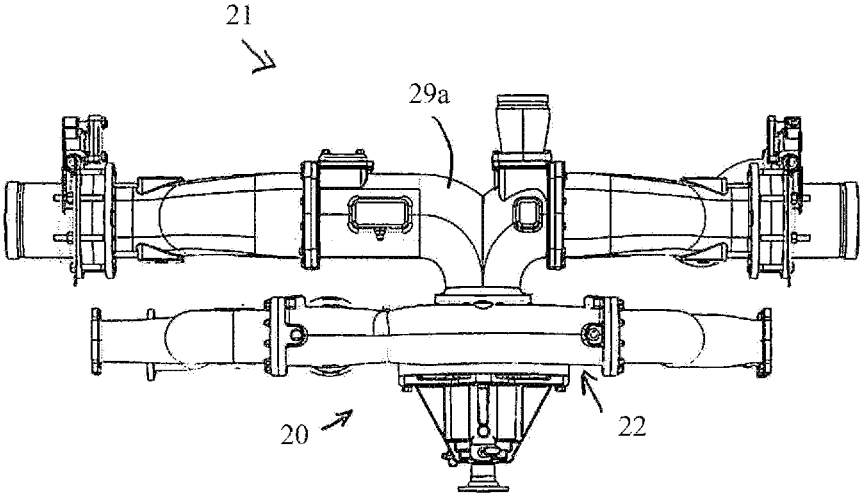
FIG. 6 is a top view of FIG. 1 with additional components in accordance with aspects of the invention.
Figure 7:
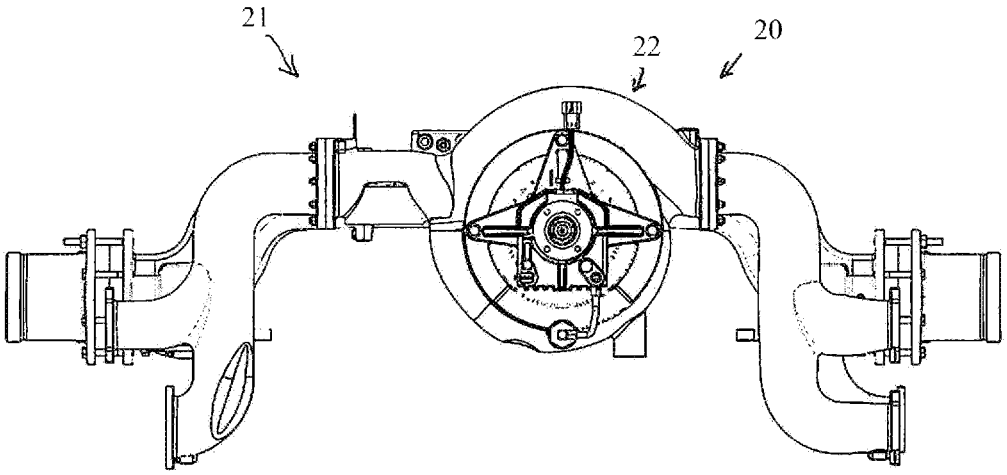
FIG. 7 is a rear view of FIG. 1 with additional components in accordance with aspects of the invention.

As shown in FIG. 3 and as may be further appreciated with respect to FIG. 4 and FIG. 5, reference line X is defined by center points 47, 49. Center points 47, 49 in one aspect are aligned along line X in both a horizontal orientation (FIGS. 3 and 4) and a casing bisecting orientation as shown in top view of FIG. 5. FIG. 6 and FIG. 7 depict further views and aspects of pump 20, casing 22, system 21 and related configurations.

Figure 8:
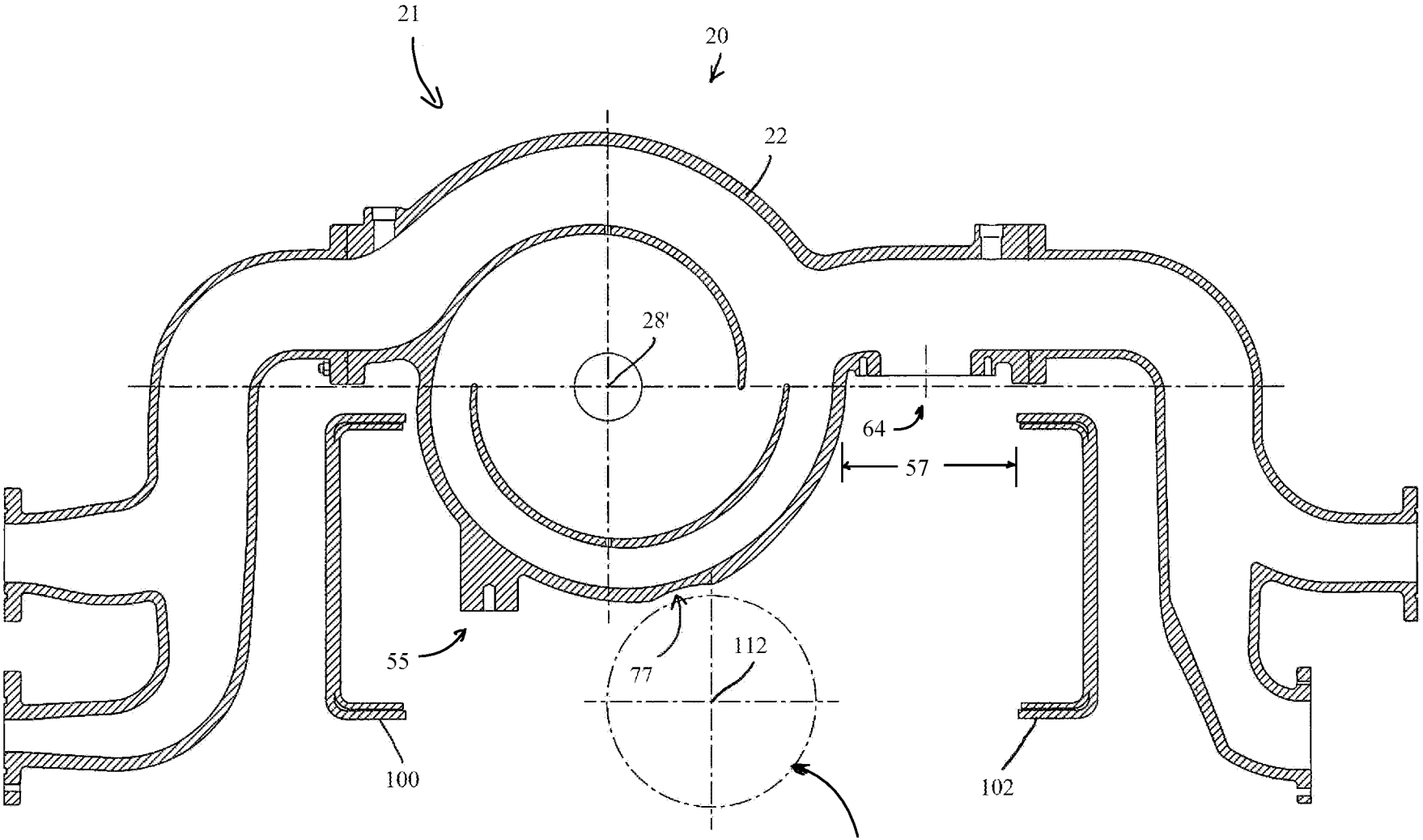
FIG. 8 is a section view of the pump of FIG. 1 in accordance with further aspects of the invention and with portions removed for clarity.
Figure 10:
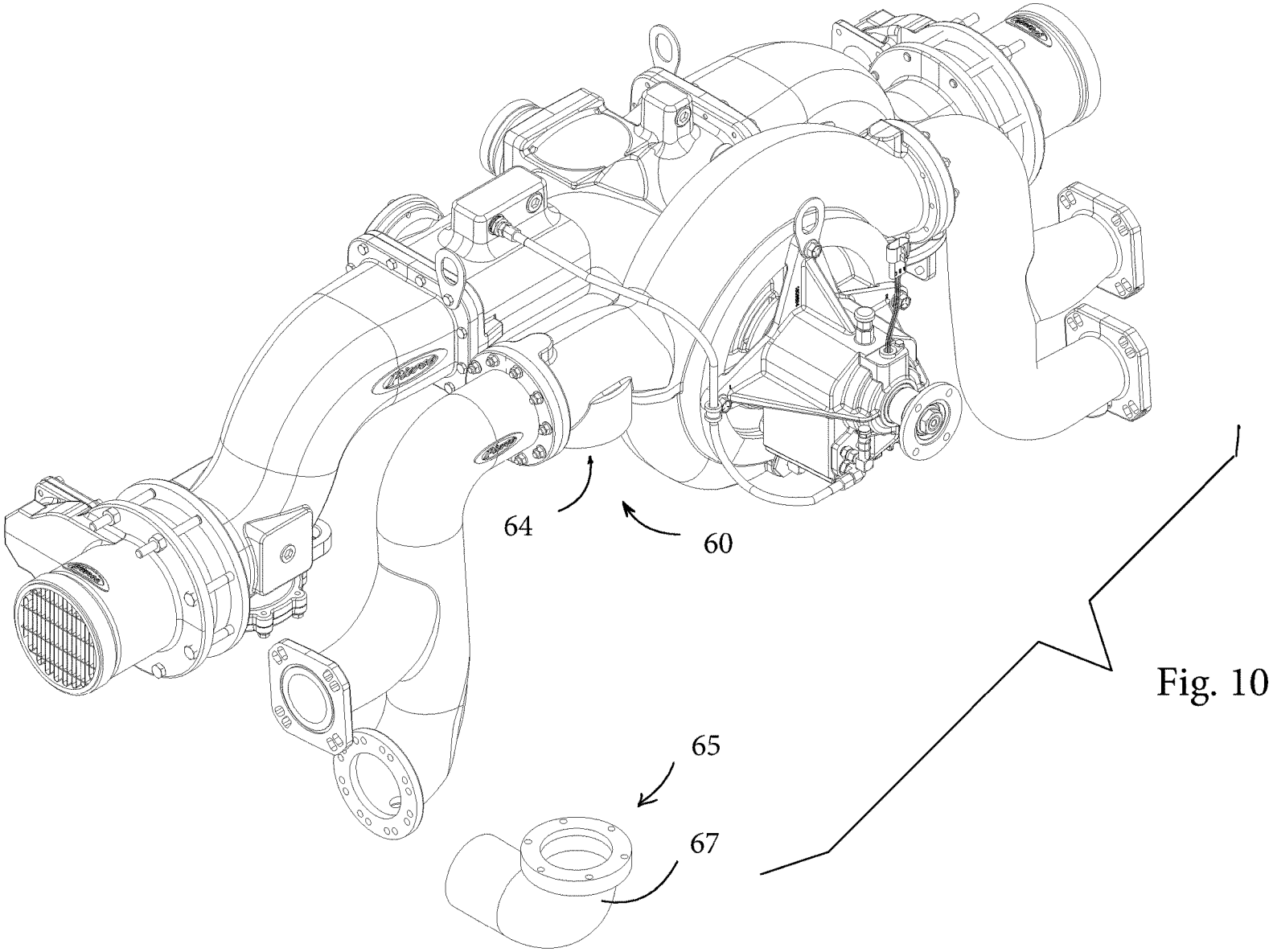
FIG. 10 is an exploded perspective view of the pump system, pump, and pump casing of FIG. 1 in accordance with further aspects of the invention.
Figure 11:
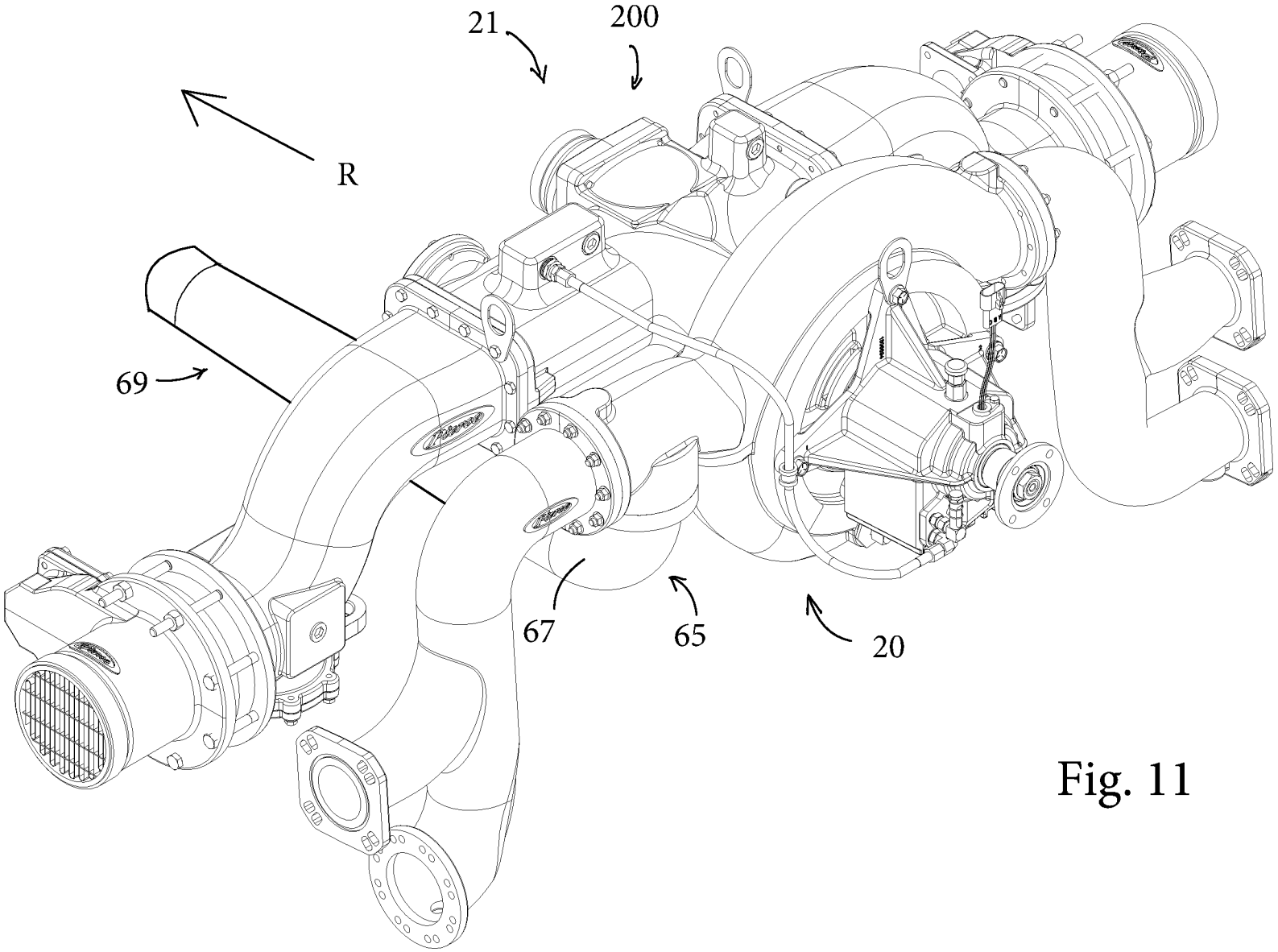
FIG. 11 is a perspective view of the pump system, pump, and pump casing of FIG. 10.
Figure 12:
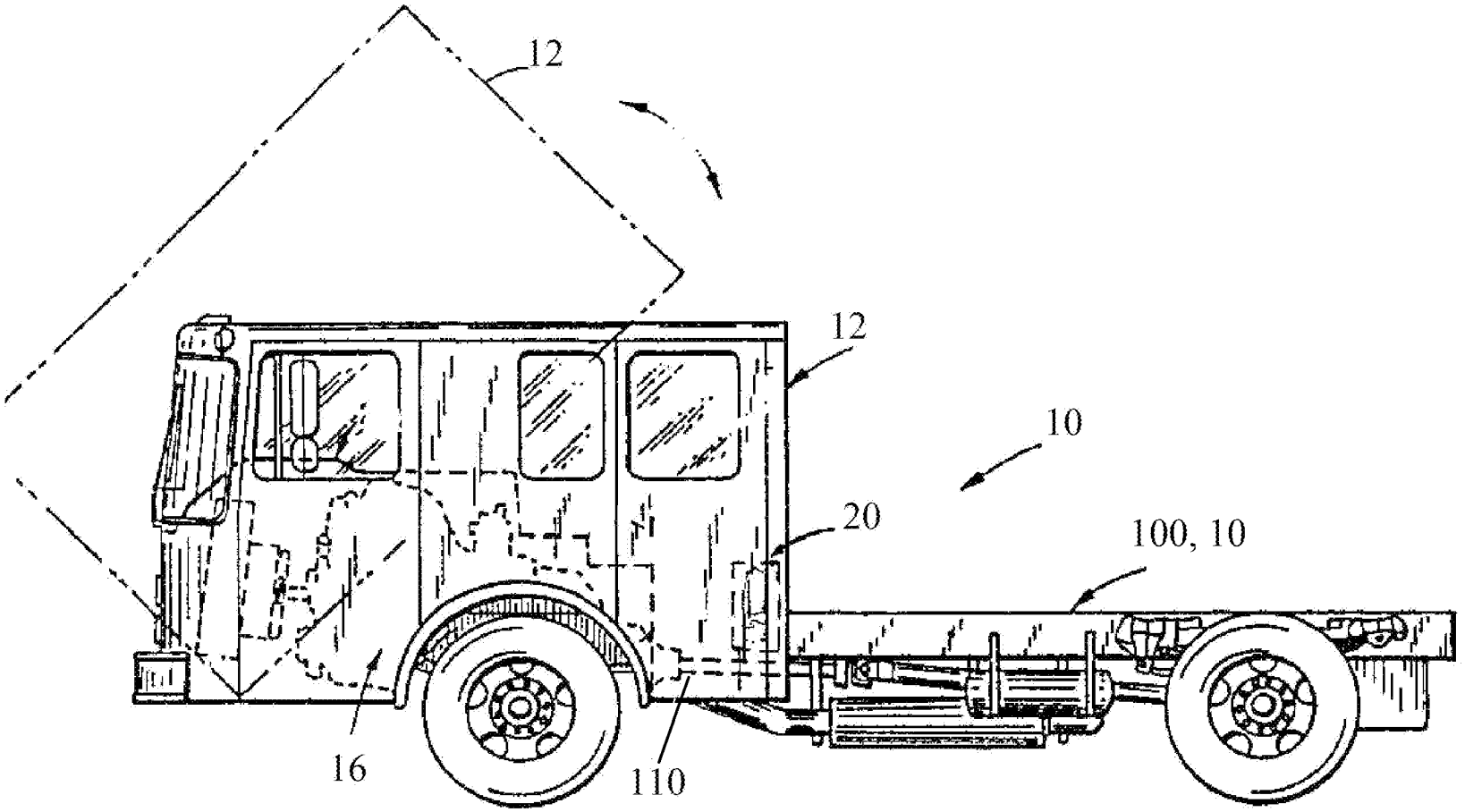
FIG. 12 is a side elevation view of a pump system and vehicle in accordance with further aspects of the present invention.

In a further aspect with reference to FIG. 8, system 21, pump 20 and casing 22 are presented within an emergency response vehicle 10 application. An emergency response vehicle such as a firetruck apparatus 10 includes vehicle frame rails 100, 102. Between the opposing rails 100, 102 is commonly positioned an engine 16 or power source (or the engine or power source is positioned at or adjacent rails 100, 102), and a horizontally centered drive shaft 110 defining a central drive shaft axis 112. The drive shaft is used to power the vehicle. In aspects, pump 20 also receives power from shaft 110. A single suction centrifugal pump 20 having casing 22 in which is positioned impeller 26 driven by an impeller shaft 28 is positioned between the rails 100, 102. The impeller shaft 28 defines a central impeller shaft axis 28'. In one aspect, pump 20, system 21 and casing 22 are positioned upon the emergency vehicle such that impeller shaft axis 28' is horizontally and vertically offset from drive shaft axis 112. Horizontally offsetting axis 28' allows casing 22 to be lowered to a close or relatively close position with respect to drive shaft 110 and associated couplings (and with respect to rail 100). Horizontally offsetting axis 28' also allows casing 22 to be oriented closer to one of the rails 100, 102, creating a clearance or gap 57. Clearance gap 57 accommodates fitting of plumbing to third discharge nozzle 64 of casing 22. Third discharge nozzle 64 is positioned at right discharge arm 60. Having a third discharge nozzle and associated opening 64 allows for additional flexibility on the discharge of fluid from the pump 20 and throughout the firetruck, including allowing for efficient filling of a tank or tanks positioned on or in the firetruck. Having a third discharge nozzle 64 and associated gap 57 allows for an elbow 67 or other fitting 65 to accommodate a third discharge line 69 to receive liquid from the pump casing 22. In one aspect with respect to FIG. 10 and FIG. 11, a fitting 65, such as an elbow 67 or other fitting such as an adapter, extender, or other conduit projecting from nozzle 64, is connected to casing 20 and receives in one instance plumbing for a third line 69. The fitting 65 or elbow 67 extends downward from the casing 20 and between rails 100, 102 to accommodate convenient connection of the third line 69 to an internal tank or to a third discharge outlet from the firetruck (in aspects the third outlet is positioned at a rear or front or other location of the vehicle). In one aspect elbow 67 is part of the third discharge line 69. FIG. 10 shows elbow 67 in an exploded position from nozzle 64. FIG. 11 shows fitting 65 and elbow 67 connected to the casing at nozzle 64 and third line plumbing 69 connected to fitting 65 and extending rearward generally in the direction of arrow "R". Plumbing 69 extending from the third nozzle 64 in this aspect runs parallel, at least in part, along rails 100, 102. A third line of discharge plumbing 69 is more easily connected to the pump 20 given the horizontal offset and gap 57. The gap 57 provides clearance from rail 102. The plumbing 69 may lead to a holding tank within the vehicle, or may terminate at an exterior panel of the vehicle. Fitting 65 and elbow 67 may be rotated to project opposite arrow "R" and in a front or forward extending orientation to service a forward area of the vehicle or to provide a discharge at a panel at a forward location of the vehicle. Elbow 67 includes a bolt pattern to receive bolts to be connected to a corresponding bolt pattern associated with nozzle 64. The opening at nozzle 64 extends downward from the casing 20 so that the third line plumbing 69 is conveniently oriented for efficient extension of a discharge line below the nozzles 46, 48 and between rails 100, 102. A cover or cap may be bolted at nozzle 64 if a third discharge line is not desired.

Figure 9:
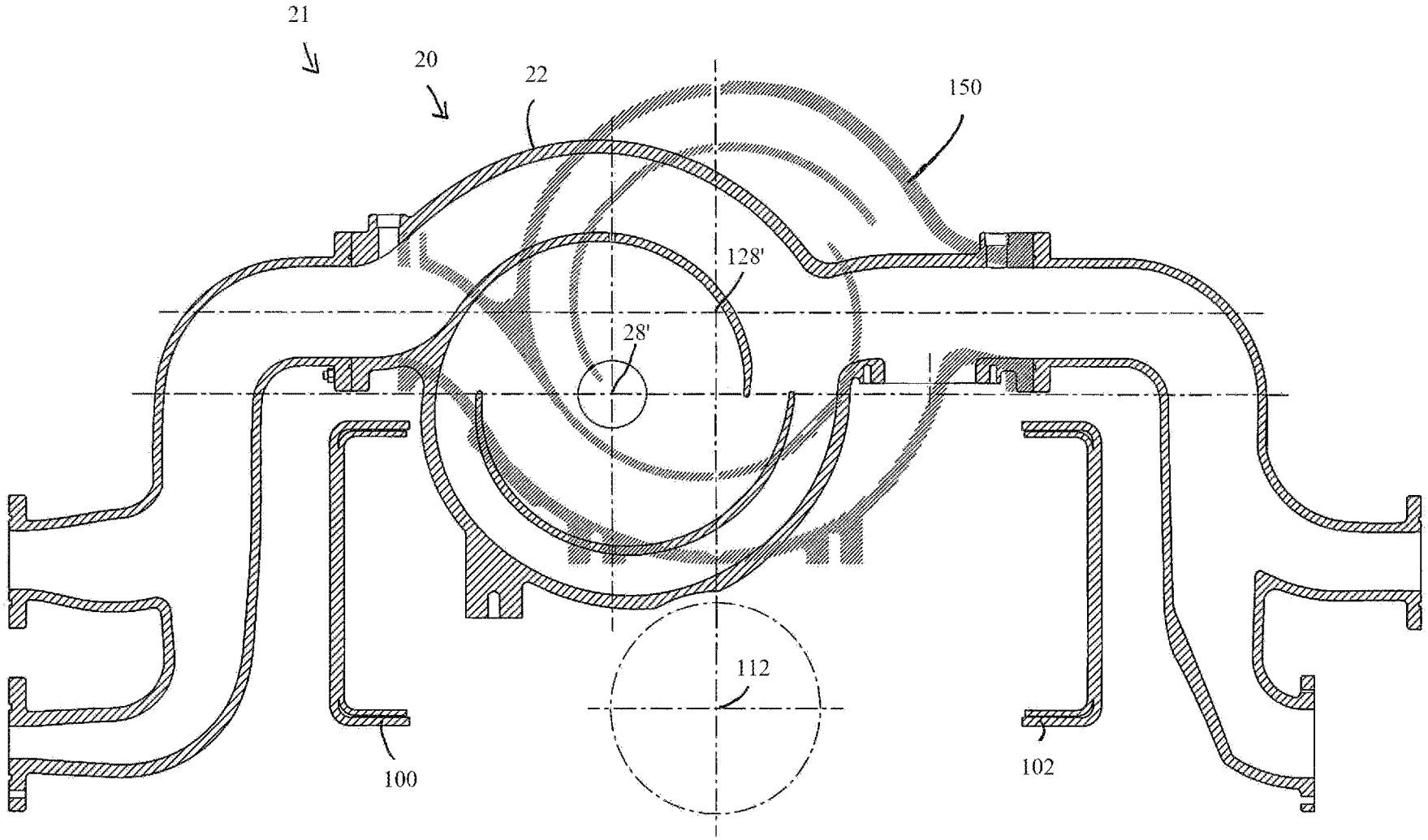
FIG. 9 is a section view of the pump of FIG. 1 in accordance with further aspects of the invention and with portions removed for clarity and in comparison to an alternative design.

In one aspect lower casing wall 24*a* includes a dimple 77 for further clearance from drive shaft 110 and associated couplings. Also having nozzles 46, 48 positioned such that line X is offset from horizontal centerline H allows for lowering casing 22 closer to axis 112 as compared to a prior arrangement as shown in FIG. 9. Moreover, simultaneously providing discharge arm 60 with an enhanced length to couple with discharge piping while discharge arm 62 also connects with corresponding discharge piping, while simultaneously having nozzles 46, 48 offset from horizontal centerline H while also simultaneously having impeller axis 28' horizontally offset from axis 112, accommodates an overall lowering of pump 20 and associated space savings.

In one example aspect of the invention, the foregoing features result in a combination where the impeller axis 28' is vertically offset from axis 112 about 13 to 14 inches compared to an arrangement as shown in FIG. 9 where a prior pump casing 150 (represented in alternative cross section markings) had a much higher 17 to 18 inches of vertical offset from axis 112 (with a corresponding higher upper location of pump casing 150). For example, impeller axis 128' of casing 150 is located about 17 to 18 inches from axis 112. Such feature is also achieved with casing 22 having a horizontal offset of about 4 to 5 inches from axis 112, where the prior pump and casing 150 has an impeller axis 128' aligned vertically with axis 112. In another aspect impeller axis 28' is vertically offset from axis 112 about 13.5 inches with a horizontal offset of about 4.5 inches; such dimensions are critical in one aspect for arranging casing 22 in a low profile and offset position within the vehicle and so that discharge outlets 46, 48 connect to existing piping of the vehicle and/or result in minimal modification to typical receiving discharge piping. The outlets 46, 48 in the example have a 4-inch diameter opening.

In a further aspect the invention includes a firefighting vehicle 10 having a third discharge line 69 which initially extends downward from the pump casing. In further aspects the third discharge line 69 travels between and at least in part parallel with rails 100, 102. The third discharge line 69 may communicate with a holding tank on the vehicle 10 or may connect to a discharge nozzle positioned at an outer panel of the vehicle 10. The outer panel of the vehicle 10 may be positioned at opposite sides of the vehicle, or at a front or back end or other panel area of the vehicle 10.

In further method aspects 200 the invention includes discharging liquid through the pump 20 situated on a vehicle such that liquid is discharged simultaneously or selectively via a first discharge nozzle 46, a second discharge nozzle 48 and/or a third discharge nozzle 64, the third discharge nozzle 64 configured to accommodate discharge of the liquid downward through the nozzle 64 and from the casing of the pump 20. In aspects the method includes discharge through a third line 69 which runs beneath nozzles 46, 48 and in part parallel with rails 100, 102.

While the present invention has been described with reference to several particular example embodiments, those skilled in the art will recognize that many changes may be made thereto without departing from the spirit and scope of the present invention, which is set forth in the following claims.

What is claimed is:

1. A single piece pump casing comprising:

a first cut-water fluid flow path, a second cut-water fluid flow path, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the first discharge nozzle and the second discharge nozzle situated substantially at opposing ends of the casing, the first discharge nozzle defining a first center output point and the second discharge nozzle defining a second center output point, the first center output point and the second center output point defining a horizontal line offset from a center point of a center opening passing through the casing.

2. The pump casing of claim 1 where the center opening has a radius from the center point, the line is offset from the center point by at least the radius of the center opening.

3. The pump casing of claim 2 where the line is offset from the center point at least 4.5 inches.

4. The pump casing of claim 1 where the line is offset upward from the center point.

5. The pump casing of claim 1 configured to receive one and only one impeller.

6. The casing of claim 1 where the first cut-water fluid flow path is defined in part by a lower casing wall, the first discharge nozzle is positioned at a first discharge arm extending outward from the lower casing wall and the second discharge nozzle is positioned at a second discharge arm extending outward from the lower casing wall.

7. The casing of claim 6 where an entirety of the discharge arms are positioned above the center point.

8. The casing of claim 6 where the first discharge arm extends from the lower casing wall a first distance, the second discharge arm extends from the lower casing wall a second distance, the first distance is at least twice the second distance.

9. The casing of claim 1 where the second joint water path runs along an upper portion within the casing, the casing further comprising a third discharge nozzle opening downward.

10. The casing of claim 1 where the center point of the center opening in part defines a horizontal center line, the line is offset and substantially parallel the horizontal center line, and where fluid travels upward at exit from the first cut-water fluid flow path.

11. A centrifugal pump comprising:

an impeller contained within a casing, the casing comprising a first cut-water fluid flow path, a first discharge nozzle, and a second discharge nozzle, the first cut-water fluid flow path communicates with the first discharge nozzle and the second discharge nozzle, the first discharge nozzle and the second discharge nozzle situated substantially at opposing ends of the pump and a first center output point of the first discharge nozzle and a second center output point of the second discharge nozzle defining a horizontal line offset from a horizontal centerline of the casing.

12. A centrifugal pump casing, comprising:

a first cut-water fluid flow path defined at least in part by a first cut-water wall, a second cut-water fluid flow path defined at least in part by a second cut-water wall, a first joint-water path and a second joint-water path, the first cut-water fluid flow path and the second cut-water fluid flow path communicating with the first joint-water path and the second joint-water path, the first joint-water path communicating with a first discharge nozzle and the second joint-water path communicating with a second discharge nozzle, the first discharge nozzle and the second discharge nozzle situated substantially at opposing ends of the casing, the first discharge nozzle defining a first center output point and the second discharge nozzle defining a second center output point, the first center output point and the second center output point defining a line offset from a center point of a center opening passing through the casing and in a spaced relationship with respect the second cut-water wall.

13. The pump casing of claim 12 wherein the first cut-water wall connects to the second discharge nozzle.

14. The pump casing of claim 12 where the line twice intersects the first cut-water wall.

* * * * *